US010351270B2

(12) United States Patent
Bouthiette

(10) Patent No.: US 10,351,270 B2
(45) **Date of Patent: *Jul. 16, 2019**

(54) SYSTEM FOR LOADING ITEMS INTO A CONTAINER-DEFINING SHEET

(71) Applicant: 9155-0020 QUÉBEC INC., Granby (CA)

(72) Inventor: Etienne Bouthiette, Montréal (CA)

(73) Assignee: 9155-0020 Quebec Inc., Granby (Quebec) (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/121,282

(22) Filed: Sep. 4, 2018

(65) Prior Publication Data

US 2018/0370664 A1 Dec. 27, 2018

Related U.S. Application Data

(63) Continuation of application No. 15/055,878, filed on Feb. 29, 2016, now Pat. No. 10,150,581.

(30) Foreign Application Priority Data

Feb. 27, 2015 (CA) ..... 2883589

(51) Int. Cl.
*B65B 1/16* (2006.01)
*F21V 23/00* (2015.01)
(Continued)

(52) U.S. Cl.
CPC ..... *B65B 1/16* (2013.01); *A61J 1/035* (2013.01); *A61J 7/0069* (2013.01);
(Continued)

(58) Field of Classification Search
CPC ..... F21Y 2113/17; F21Y 2115/10; F21Y 2115/00; F21V 23/003; F21V 33/0064;
(Continued)

(56) References Cited

U.S. PATENT DOCUMENTS 5,788,079 A 8/1998 Bouthiette
9,311,452 B2 4/2016 Dickie
(Continued)

FOREIGN PATENT DOCUMENTS

CA 2843074 2/2015

*Primary Examiner* — David J Walczak
(74) *Attorney, Agent, or Firm* — Baker & Hostetler LLP

(57) ABSTRACT

A system for loading items into a container-defining sheet. The system includes a support for receiving the container-defining sheet, the support having a top surface provided with a number of apertures equal to the number of cavities embossed in the container-defining sheet. A support illumination board is positioned on a back portion of the support. The illumination board includes a plurality of evenly-spaced-apart support light indicators, each support light indicator being positioned substantially centrally with respect to a corresponding aperture of the support and adapted to back-illuminate one of the containers of the container-defining sheet upon placement of the container-defining sheet into the support. An illumination board controller controls operation of the support light indicators to indicate into which container of the container-defining sheet each item is to be loaded. An enclosure includes drawers holding items to be put into the container-defining sheet.

10 Claims, 27 Drawing Sheets

(51) Int. Cl.

| | |
|---|---|
| ***A61J 7/00*** | (2006.01) |
| ***A61J 1/03*** | (2006.01) |
| ***F21V 33/00*** | (2006.01) |
| *A61J 7/04* | (2006.01) |
| *F21Y 113/17* | (2016.01) |
| *F21Y 115/10* | (2016.01) |

(52) U.S. Cl.
CPC ..... *F21V 23/003* (2013.01); *F21V 33/0064* (2013.01); *A61J 7/04* (2013.01); *F21Y 2113/17* (2016.08); *F21Y 2115/10* (2016.08)

(58) Field of Classification Search
CPC ..... B25J 15/0625; B65B 1/16; A61J 7/0069; A61J 1/035; A61J 7/04; A61J 7/0409; A61J 7/0418; A61J 7/0427; A61J 7/0481; A61J 7/0084; A61J 7/0436; A61J 2200/30; A61J 2205/20
See application file for complete search history.

(56) References Cited

U.S. PATENT DOCUMENTS

| | | | |
|---|---|---|---|
| 9,717,654 | B2 | 8/2017 | Dickie |
| 9,798,862 | B2 | 10/2017 | Parviainem |
| 9,827,164 | B2 | 11/2017 | Illarramendi et al. |

SYSTEM FOR LOADING ITEMS INTO A CONTAINER-DEFINING SHEET

CROSS-REFERENCE TO RELATED APPLICATIONS

This application is a Continuation application of U.S. patent application Ser. No. 15/055,878 filed Feb. 29, 2016, now U.S. Pat. No. 10,150,581, which claims priority to foreign application no. CA 2883589 filed Feb. 27, 2015, the entire contents of which are incorporated herein by reference.

BACKGROUND OF THE INVENTION

The present invention relates to filling packaging. More particularly, the present invention relates to a system for loading items into a container-defining sheet.

BRIEF DESCRIPTION OF THE PRIOR ART

It is of common practice in the pharmaceutical field to prepare sets of individual containers containing pills and/or tablets to be administered to a patient. Each of these containers contains pills and/or tablets that the patient has to take together at the same time during the day over a given period of time (preferably one week or one month). Each set can include 28 to up to 32 cells which can thus supply a month-worth of pills To prepare such sets of individual pill containers for use by a patient, it is also of common practice to use a sheet of plastic material in which a plurality of cavities are embossed. Each of these cavities defines a small upwardly opened container that can be filled with pills. After filling, all the containers are closed by means of a sealing sheet on which all desirable indications can be printed, like the patient's name, the date and hour of administration, etc. As it can be understood, the indications are printed and formatted onto the sealing sheet so that each group of information referring to a given container is positioned in regard to said container. Tearing lines are provided on both the container-defining sheet and the sealing sheet to permit easy separation of the individual pill containers.

For further information as to the structure, manufacture and use of such sets of individual pill containers, reference can be made to U.S. Pat. No. 5,788,079.

Often, a professional such as a pharmacist will manually fill each pocket of the blister pack with a corresponding tablet, or with many different tablets for a same dosage period. It can be appreciated that one disadvantage associated with this technique is that it takes a long time to fill all the pockets of the blister pack, especially when filling out a prescription of medication for a long duration. It may further disadvantageously lead to human errors by placing the incorrect tablet in a corresponding pocket, as the quantities and types of medication to be inserted in each pocket can vary from one pocket to another.

Hence, in light of the aforementioned, there is a need for a system which, by virtue of its design and components, would be able to overcome some of the above-discussed prior art concerns.

SUMMARY OF THE INVENTION

One object of the present invention is to provide a solution to at least one of the above-mentioned prior art drawbacks.

In accordance with an aspect of the present invention, there is provided a system for loading items into a container-defining sheet made of a plastic material, said container-defining sheet having a top surface comprising a given number of evenly spaced apart cavities embossed therein and defining a plurality of containers, the system comprising:

- a support for receiving the container-defining sheet, the support having a top surface provided with a number of apertures at least equal to the number of cavities embossed in the container-defining sheet, said apertures being positioned, shaped and sized to receive the containers defined by said cavities embossed in the container-defining sheet;
- a support illumination board positioned on a back portion of the support, the support illumination board comprising a plurality of evenly-spaced-apart support light indicators, each support light indicator being positioned substantially centrally with respect to a corresponding aperture of the support and each support light indicator being adapted to back-illuminate one of said containers of the container-defining sheet upon placement of the container-defining sheet into the support; and
- a support illumination board controller connected to the support illumination board, the support illumination board controller controlling operation of the support light indicators to indicate into which container of the container-defining sheet each item is to be loaded.

In some implementations, the support illumination board controller comprises a microcontroller.

In some implementations, the light indicators are high intensity light emitting diodes (LEDs).

In some implementations, the high intensity LEDs are multi-color LEDs.

In some implementations, the system further includes:

at least one enclosure comprising:

- a plurality of drawers, each drawer being adapted to hold items to be loaded into the container-defining sheet;
- an enclosure illumination assembly affixed to the enclosure, the enclosure illumination assembly comprising a plurality of enclosure light indicators, each enclosure light indicator being positioned proximate one of said plurality of drawers of the enclosure and each enclosure light indicator being adapted to illuminate said one of said plurality of drawers of the enclosure; and
- an enclosure illumination assembly controller connected to the enclosure illumination assembly, the enclosure illumination assembly controller controlling operation of the enclosure light indicators to indicate from which drawer of the enclosure each item is to be taken for loading into the container-defining sheet.

In some implementations, each enclosure further comprises a door assembly removably positionable in front of the plurality of drawers thereby blocking opening of the drawers and facilitating transport of the enclosure from one location to another.

In some implementations, each enclosure further comprises a locking mechanism for locking the door assembly.

In some implementations, the system includes a plurality of enclosures, each enclosure comprising interfaces allowing an arrayed arrangement of the plurality of enclosures.

In some implementations, the enclosure illumination assembly controller comprises a plurality of interconnected enclosure printed circuit boards, said enclosure printed circuit boards comprising at least one master board and at least one slave board.

In some implementations, the support illumination board controller comprises a plurality of interconnected support printed circuit boards, said support printed circuit boards comprising at least one master board and at least one slave board.

In some implementations, the system further includes an item transfer system for transferring items from the enclosure to the container-defining sheet, comprising:

- a vacuum supply for generating suction; and
- a filling assembly comprising:
  - a handle;
  - a manifold mounted about the handle and in fluid engagement with the vacuum supply for receiving suction;
  - a valve operatively connected to the manifold and manually operable between a retain configuration wherein the valve is in an open position and suction is supplied to the manifold, and a release configuration wherein the valve is in a closed position and the manifold is free of suction; and
  - a plurality of prongs in fluid engagement with the manifold and extending therefrom, each prong configured for applying suction to a corresponding item upon the valve being in the retain configuration, thereby retaining the object, and each prong configured for releasing the retained object in a corresponding cavity of the container-defining sheet upon the valve being in the release configuration, thereby filling the container-defining sheet.

In some implementations, the system further includes a manipulator system, such as a robotic manipulator system, for displacing the filling assembly towards the container-defining sheet.

This invention and its numerous advantages will be better understood upon reading the following non-restrictive description of preferred embodiments thereof, made with reference to the accompanying drawings.

DESCRIPTION OF PREFERRED EMBODIMENTS OF THE INVENTION

Figure 1:
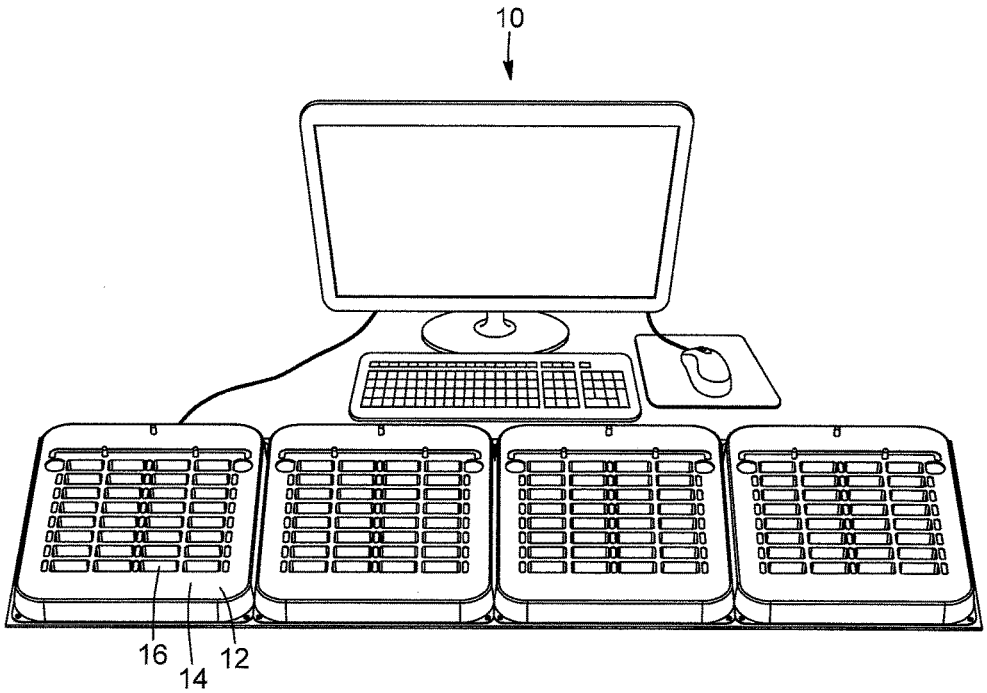
FIG. 1 is a perspective view of a system according to an embodiment of the invention.

As shown in FIG. 1, in accordance with an aspect of the present invention, there is provided a system 10 for loading items into a container-defining sheet made of a plastic material. Although the present invention has been developed in the context of manipulating medicaments or pills, other types of items can be manipulated without departing from the scope of the present invention. The container-defining sheet has a top surface including a given number of evenly spaced apart cavities embossed therein and defining a plurality of containers. An example of such a container-defining sheet is shown for example in U.S. Pat. No. 5,788,079. The system 10 includes a support 12 for receiving the container-defining sheet. The support 12 has a top surface 14 provided with a number of apertures 16 at least equal to the number of cavities embossed in the container-defining sheet. The apertures 16 are positioned, shaped and sized to receive the containers defined by said cavities embossed in the container-defining sheet.

Figure 2:
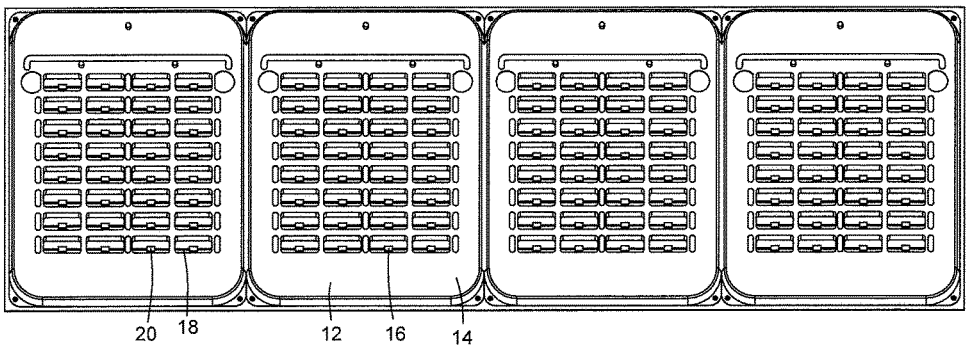
FIG. 2 is a perspective view of the support and support illumination board of the system shown in FIG. 1.
Figure 3:
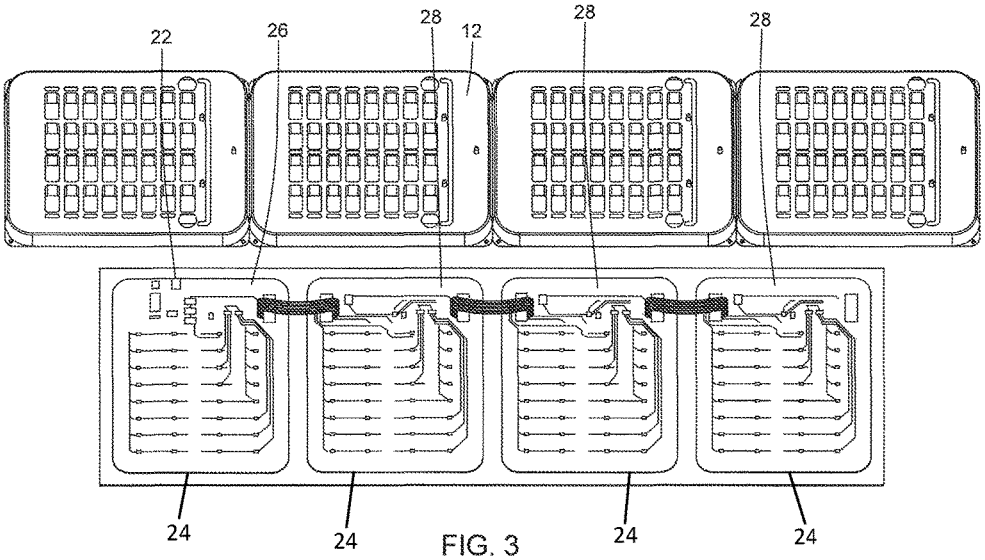
FIG. 3 is an exploded perspective view of the support and support illumination board of the system shown in FIG. 1.
Figure 4:
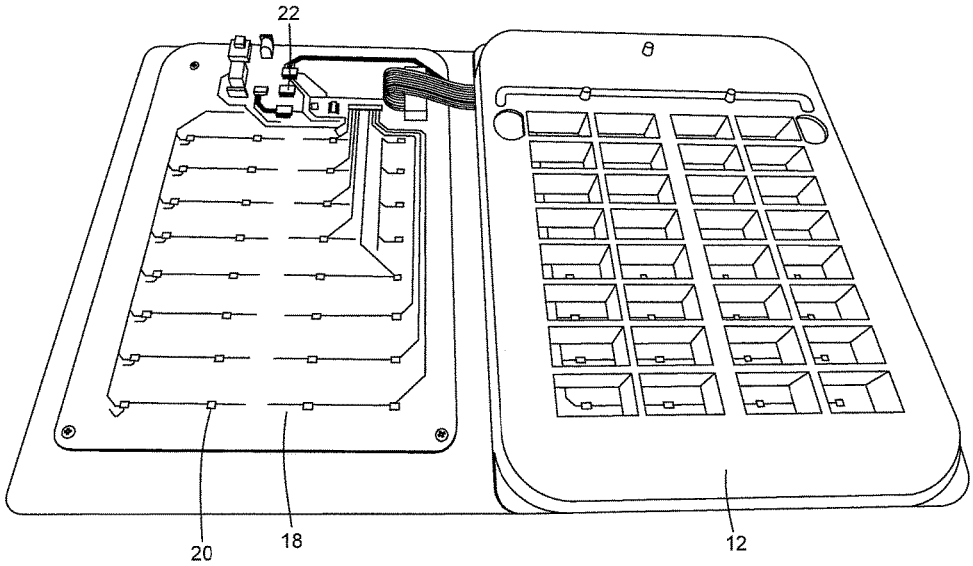
FIG. 4 is a perspective view of the system shown in FIG. 1 with one support element removed.
Figure 5:
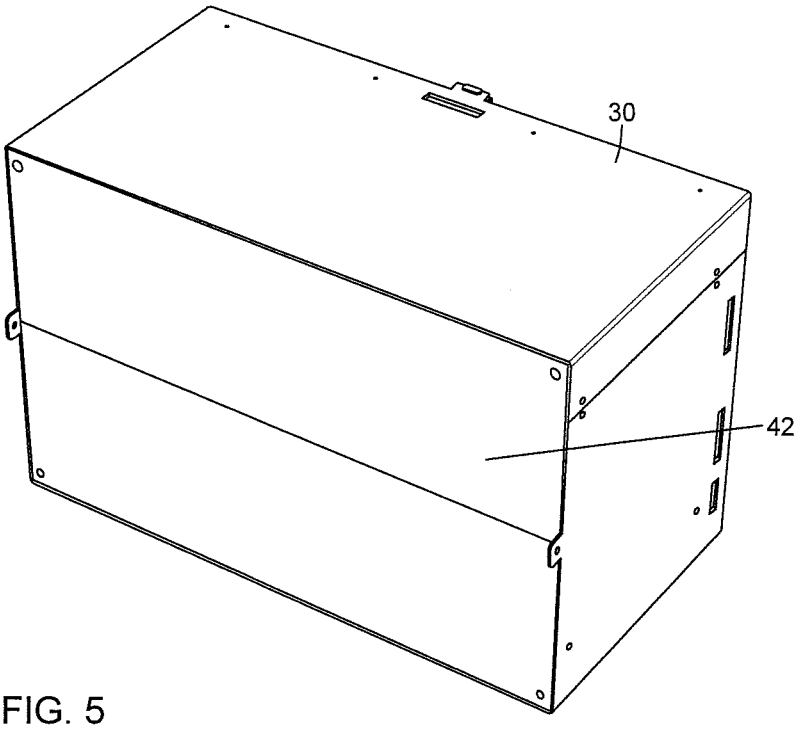
FIG. 5 is a front perspective view of an enclosure that can be used with the system shown in FIG. 1 according to an embodiment of the invention.
Figure 6:
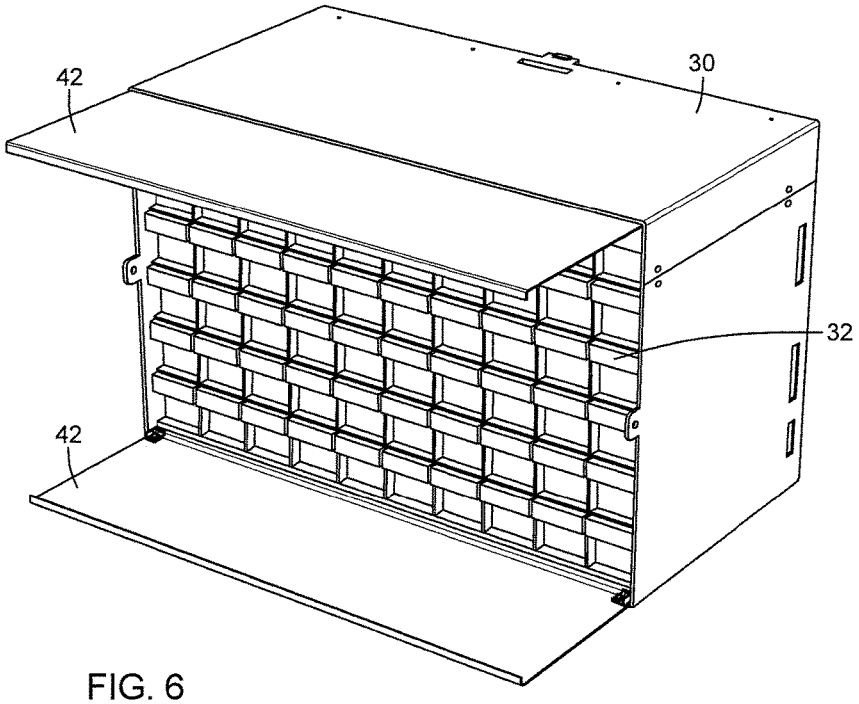
FIG. 6 is a front perspective view of the enclosure shown in FIG. 5 with their door assemblies in an open configuration.
Figure 7:
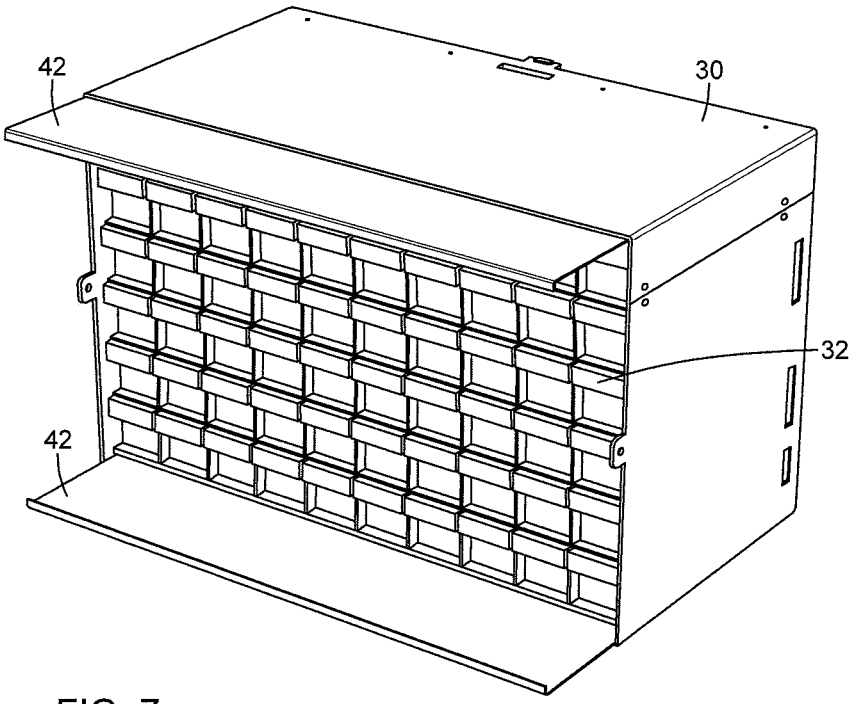
FIG. 7 is a front perspective view of the enclosure shown in FIG. 5 with their door assemblies in a partially retracted configuration.
Figure 8:
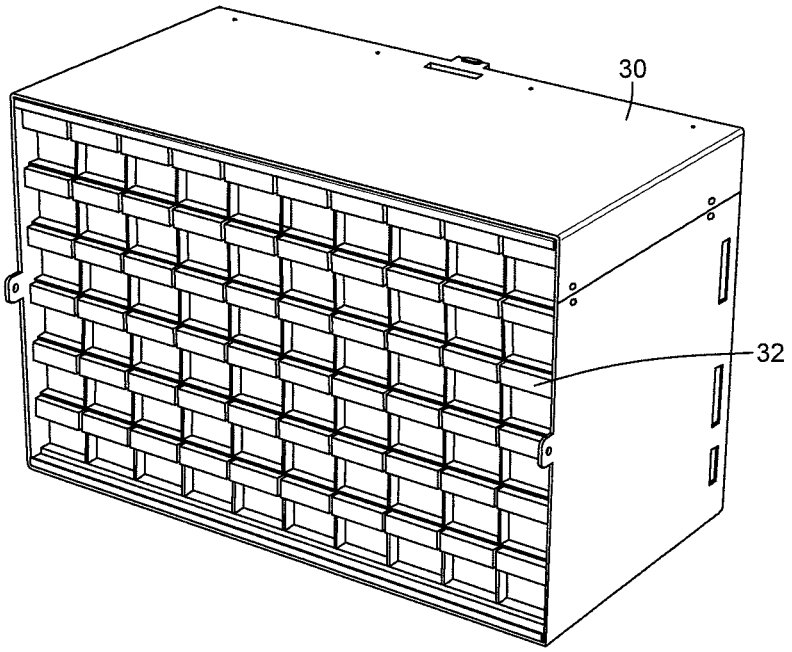
FIG. 8 is a front perspective view of the enclosure shown in FIG. 5 with their door assemblies in a fully retracted configuration.
Figure 9:
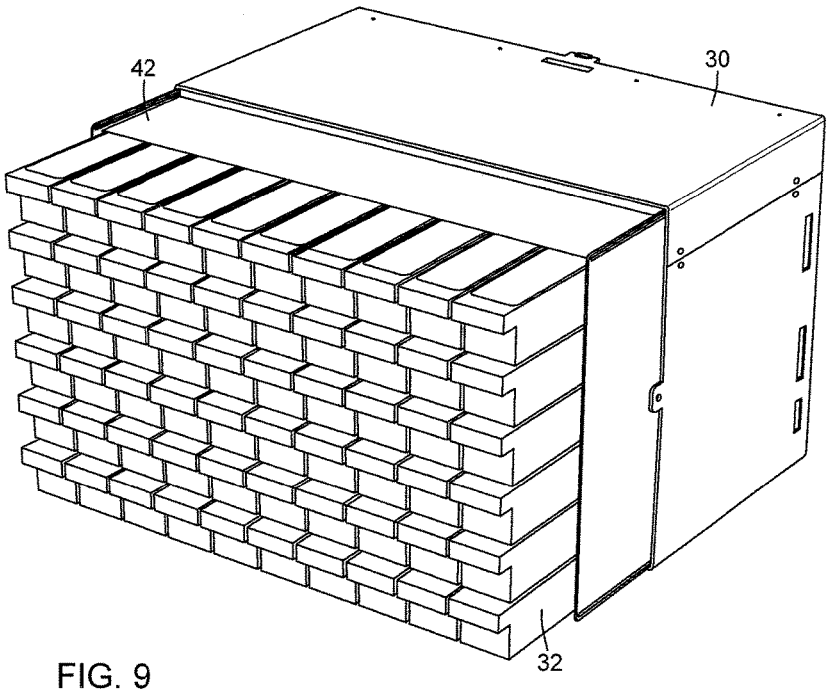
FIG. 9 is a front perspective view of the enclosure shown in FIG. 5 with drawers in a deployed configuration.
Figure 10:
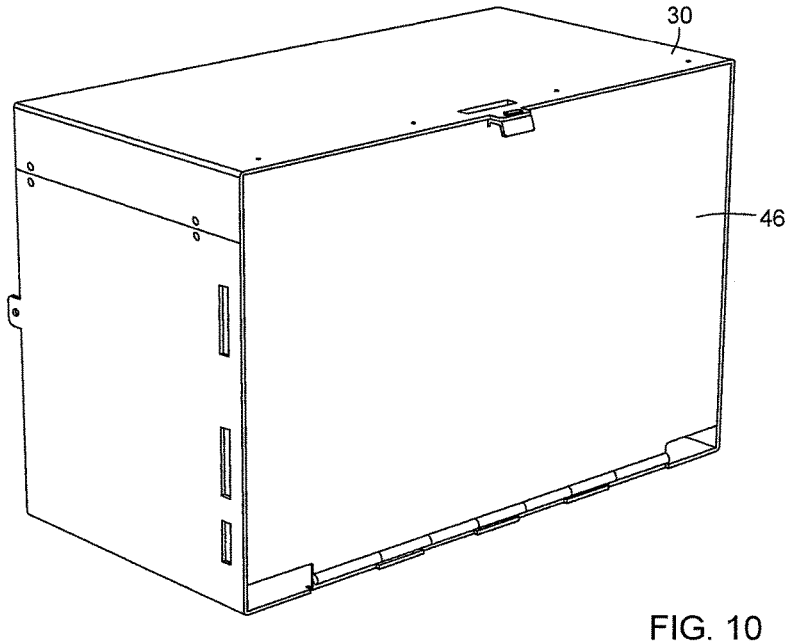
FIG. 10 is a rear perspective view of the enclosure shown in FIG. 5.

As better shown in FIGS. 2 to 4, a support illumination board 18 is positioned on a back portion of the support 12. The support illumination board 18 includes a plurality of evenly-spaced-apart support light indicators 20. Each support light indicator 20 is positioned substantially centrally with respect to a corresponding aperture 16 of the support 12 and each support light indicator 20 is adapted to back-illuminate one of said containers of the container-defining sheet upon placement of the container-defining sheet into the support 12. A support illumination board controller 22 is connected to the support illumination board 18, the support illumination board controller controlling operation of the support light indicators to indicate into which container of the container-defining sheet each item is to be loaded.

In some implementations, the support light indicators 18 are high intensity light emitting diodes (LEDs).

In some implementations, the high intensity LEDs are multi-color LEDs. Such LED illuminators are chosen to operate effectively even in well-lit environments, which is not the case with certain prior art systems. Typical applications for these kind of LED are backlighting (LCD, illuminated advertising, general lighting), or displays for traffic.

In some implementations, the support illumination board controller 22 can comprise a microcontroller.

In some implementations, as better shown in FIG. 3, the support illumination board controller 22 can comprise a plurality of interconnected support printed circuit boards 24, the support printed circuit boards including at least one master board 26 linked to a plurality of slave boards 28. As printed circuit boards typically are offered in standard maximum sizes, using a plurality of interconnected printed circuit boards, for example 1 master and 3 slave boards as shown in FIG. 3, allows the construction of large-sized support structures for multiple container-defining sheets. In one embodiment, the support illumination board controller requires a 12V power supply to power all the LEDs. Communication between the controller and a computer can be set up wirelessly.

Rows or columns of the array of LED illuminators can be constantly scanned or periodically controlled such that each illuminator is turned on for example for $1/12^{th}$ of the time, while providing an illusion of being constantly turned on.

Figure 11:
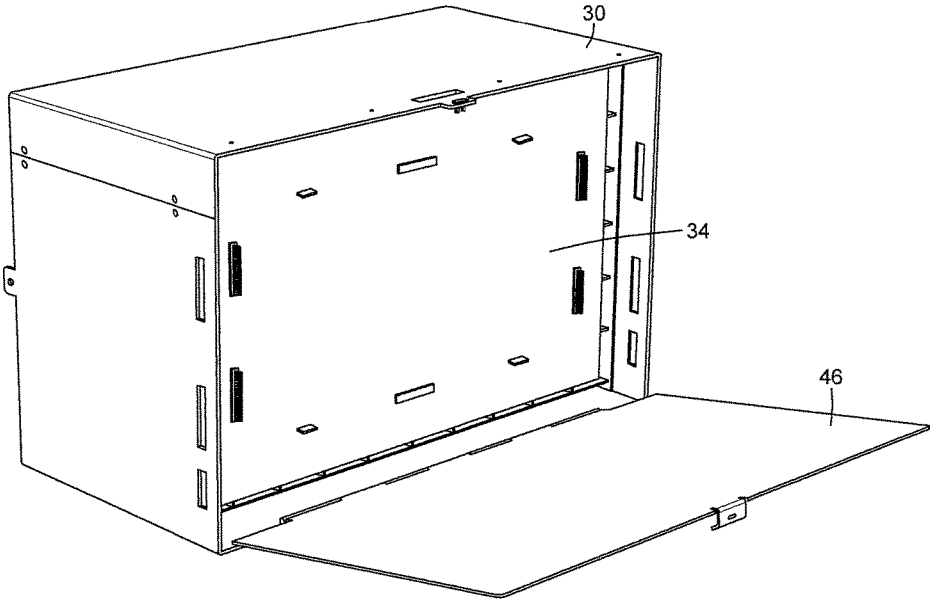
FIG. 11 is a rear perspective view of the enclosure shown in FIG. 10, with the rear door in an open configuration.
Figure 12A:
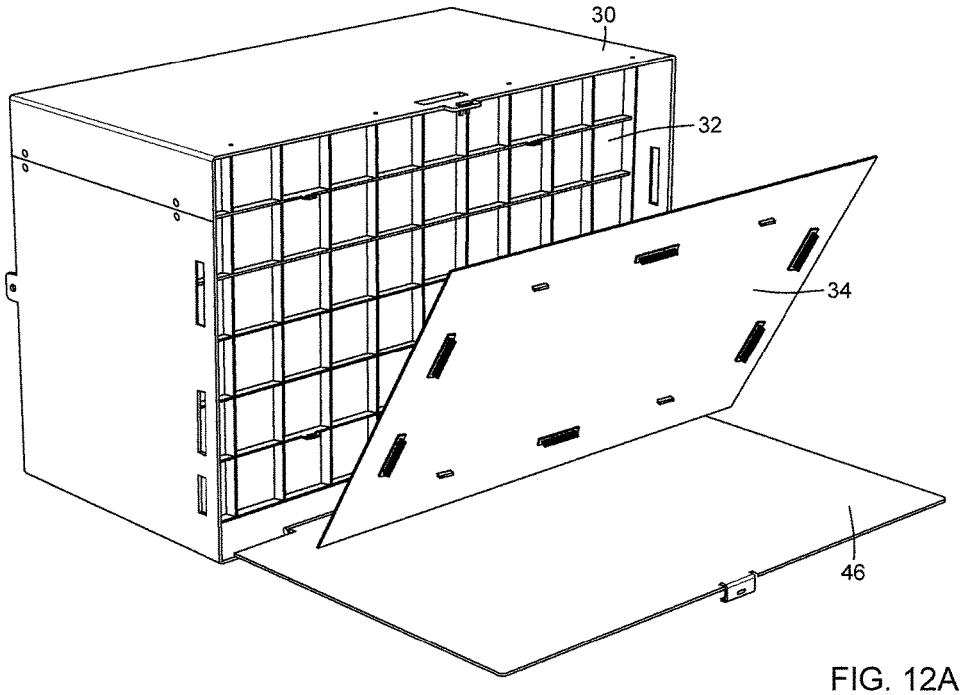
FIG. 12A is a rear perspective view of the enclosure shown in FIG. 10, with the rear door in an opened configuration and illustrating removal of an enclosure illumination assembly.
Figure 12B:
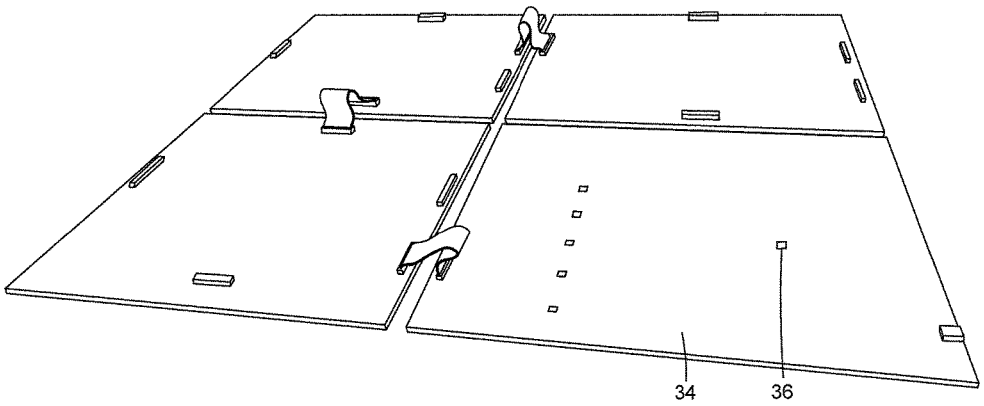
FIG. 12B is a top perspective view of an enclosure illumination assembly in accordance with another embodiment of the invention.
Figure 26:
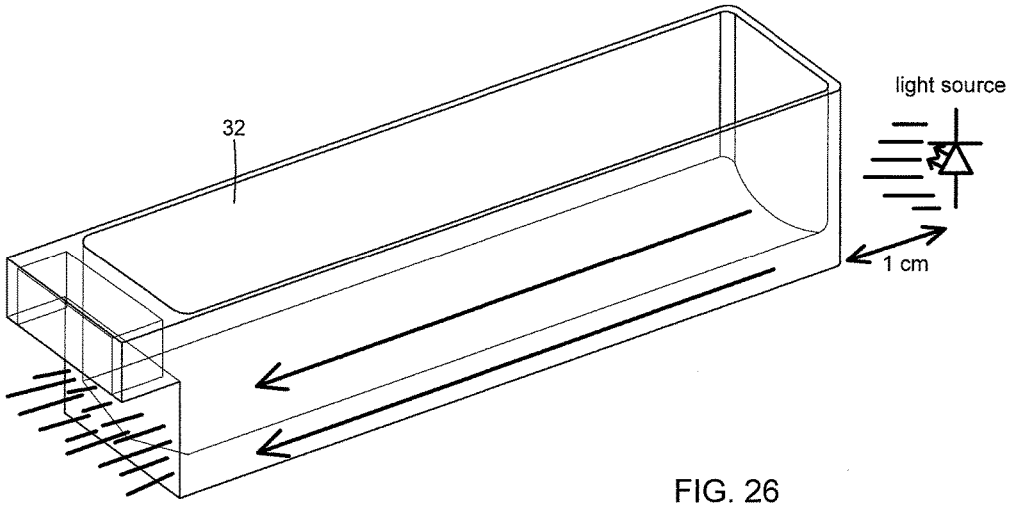
FIG. 26 is a perspective view of an interaction between a drawer and a light source according to an embodiment of the present invention.

In some implementations, as shown in FIGS. 5 to 20, the system can further include at least one enclosure 30 having a plurality of drawers 32. Each drawer 32 is adapted to hold items to be loaded into the container-defining sheet. As better shown in FIGS. 11 and 12A an enclosure illumination assembly 34 can be affixed to the enclosure 30. The enclosure illumination assembly 34 includes a plurality of enclosure light indicators, each enclosure light indicator being positioned proximate one of the plurality of drawers of the enclosure 30. Each enclosure light indicator is adapted to illuminate one of the plurality of drawers of the enclosure. As better shown in FIG. 12B, an enclosure illumination assembly controller 36 can be connected to the enclosure illumination assembly 34. The enclosure illumination assembly controller 36 controls operation of the enclosure light indicators to indicate from which drawer of the enclosure each item is to be taken for loading into the container-defining sheet. In an embodiment of the present invention shown in FIG. 26, the lights are preferably positioned at the bottom of each drawer 32 to make sure the light goes through the transparent plastic and not blocked by the items or pills.

Figure 13:
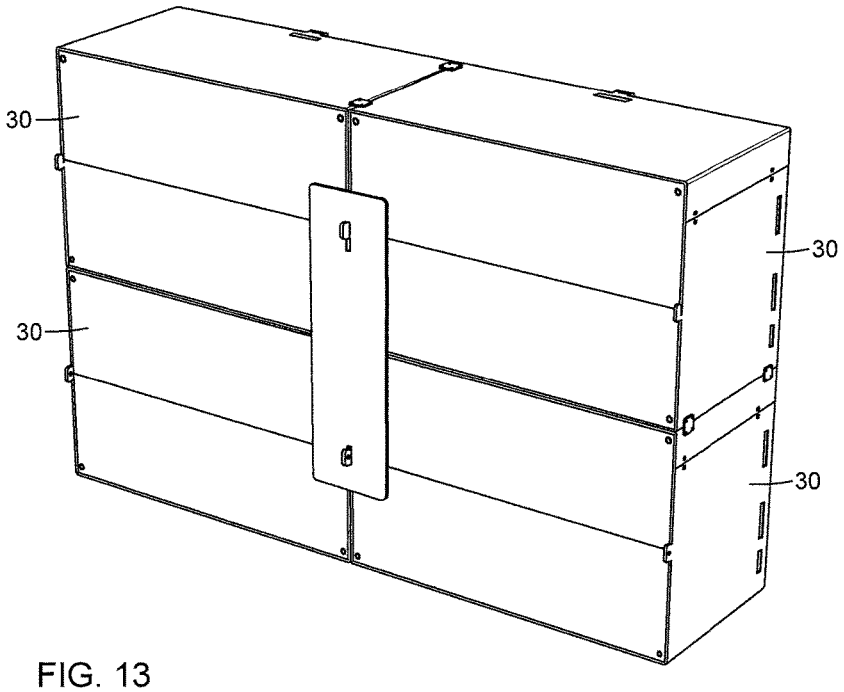
FIG. 13 is a front perspective view of a plurality of enclosures stacked together in accordance with another embodiment of the invention.
Figure 14:
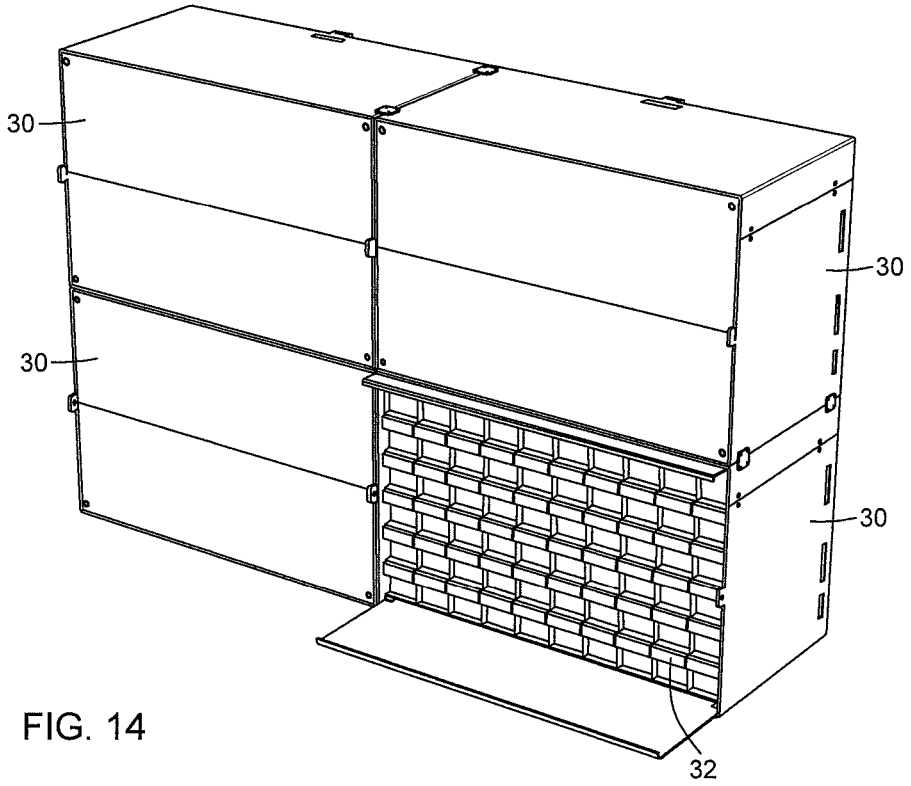
FIG. 14 is a front perspective view of the plurality of enclosures shown in FIG. 13, with a door assembly of one of the enclosures in an open configuration.
Figure 15:
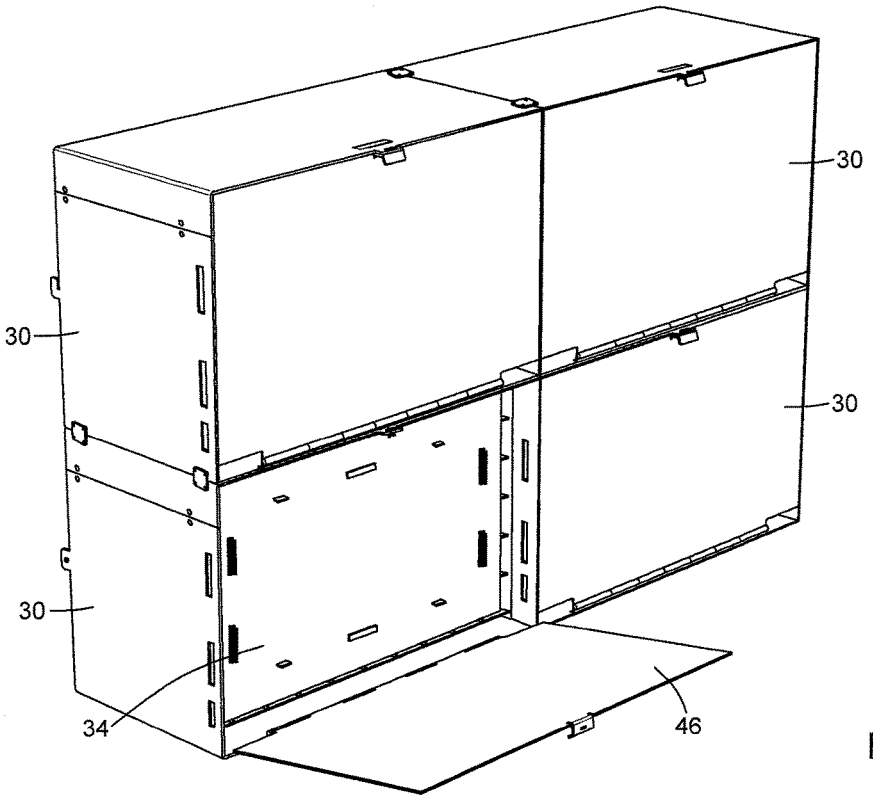
FIG. 15 is a rear perspective view of the plurality of enclosures shown in FIG. 13, with a door assembly of one of the enclosures in an open configuration.
Figure 16:
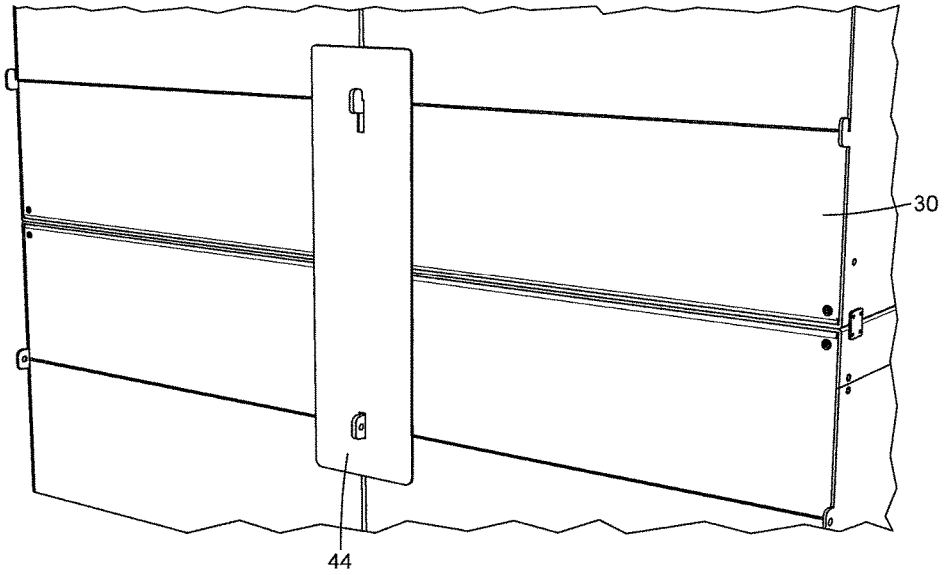
FIG. 16 is a detailed front perspective view the plurality of enclosures shown in FIG. 13 with a locking plated inserted thereupon.
Figure 17:
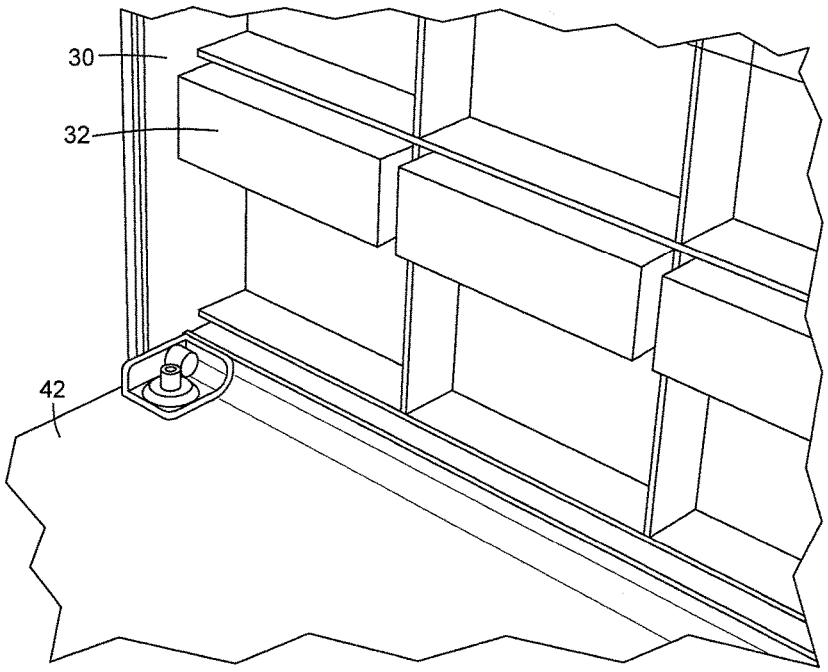
FIG. 17 is a detailed front perspective view the plurality of enclosures shown in FIG. 13 showing a pivot connection for the front door assembly.
Figure 18:
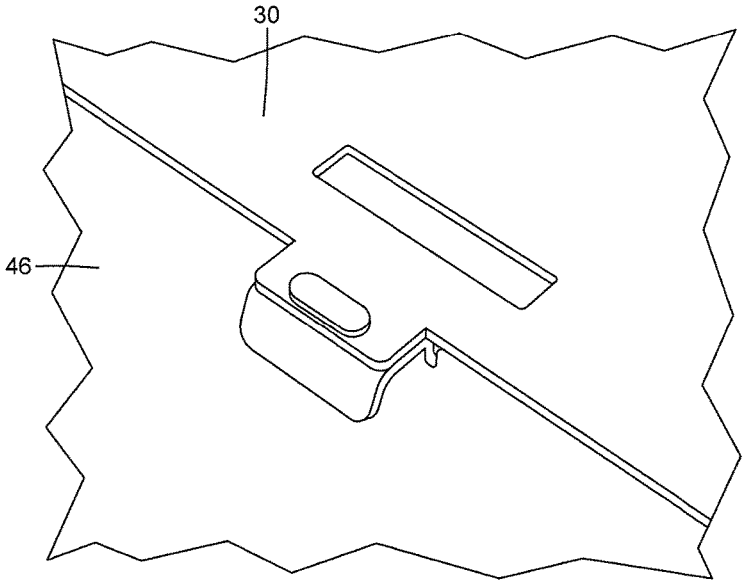
FIG. 18 is a detailed rear perspective view the plurality of enclosures shown in FIG. 13 showing a locking mechanism for a rear door.
Figure 19:
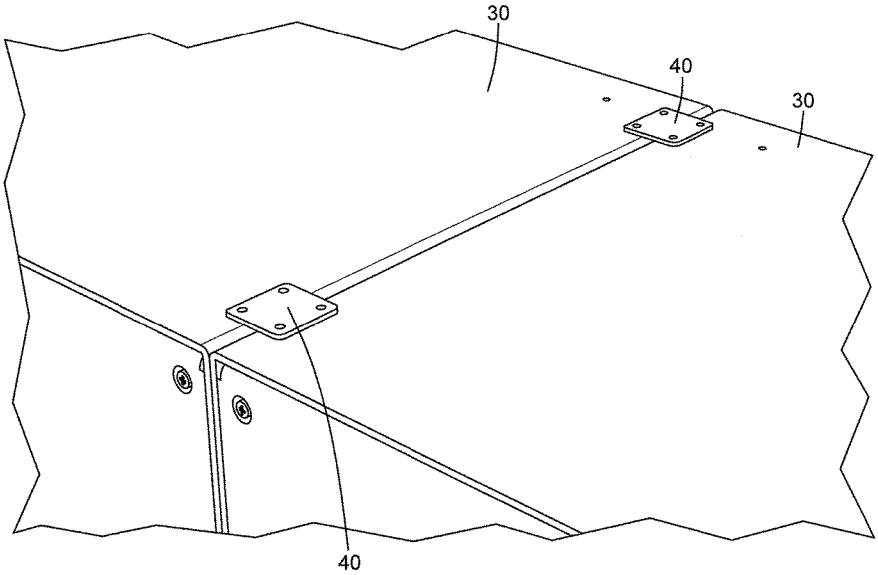
FIG. 19 is a top perspective view of an interface linking two adjacent enclosures according to an embodiment of the present invention.
Figure 20:
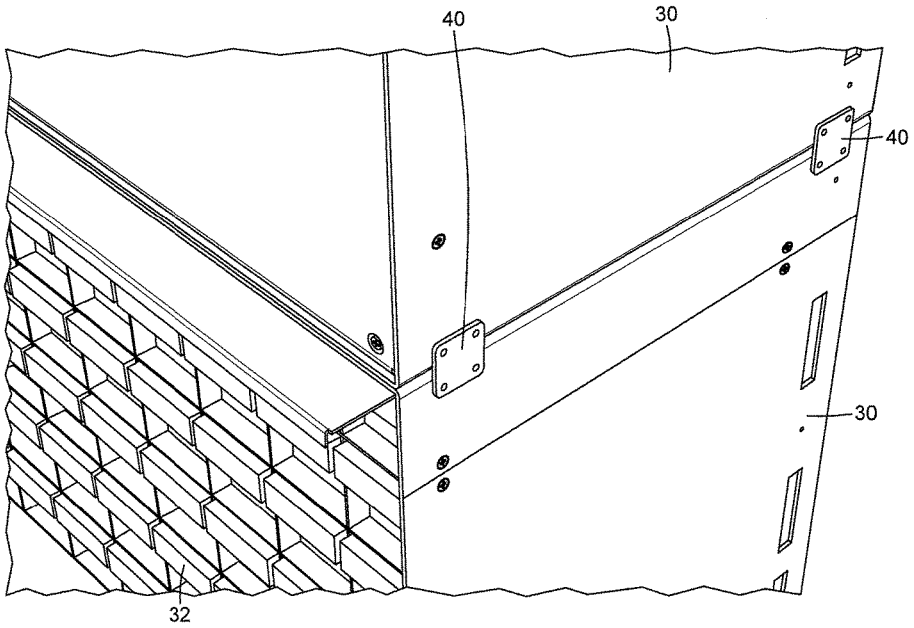
FIG. 20 is a side perspective view of an interface linking two stacked enclosures according to an embodiment of the present invention.

In some implementations as shown in FIGS. 13 to 15, the system includes a plurality of enclosures, each enclosure comprising interfaces allowing an arrayed arrangement of the plurality of enclosures.

In some implementations, the enclosure illumination assembly controller comprises a plurality of interconnected enclosure printed circuit boards, the enclosure printed circuit boards comprising at least one master board and at least one slave board. As printed circuit boards typically are offered in standard maximum sizes, using a plurality of interconnected printed circuit boards, for example 1 master and 3 slave boards as shown in FIGS. 13 to 15, allows the construction of a large-sized assembly including several enclosures. In one embodiment, the enclosure illumination board controller requires a 5V power supply to individually power one single illuminator at a time. Hence the enclosure illumination board controller can be powered for example through a computer USB port or batteries, even if the enclosure light indicators can have a higher intensity (up to 145 lumen) than that of the support light indicators In some implementations, the support illumination board controller is independent from the enclosure illumination board controller. The controllers can be connected to a computer through its communication (COM) ports. Hence the illumination of the support or the enclosures can be controlled independently (and one of the support or enclosure can be illuminated in the absence of the other). In the alternative, the support and the enclosure can be illuminated in a coordinated manner such that an enclosure light indicator indicates from which individual drawer of the enclosure each item or pill is to be taken for loading into the container-defining sheet onto a corresponding illuminated portion of the support which back-lights the appropriate container of the sheet.

In some implementations, each enclosure 30 further comprises a door assembly 42 removably positionable (as shown in FIGS. 5 to 8) in front of the plurality of drawers 32 thereby blocking opening of the drawers and facilitating transport of the enclosure 30 from one location to another.

In some implementations, as shown in FIG. 15, each enclosure can further include a locking mechanism 44 for locking the door assembly 42.

In some implementations, as shown in FIGS. 10 to 12A, each enclosure can further include a back door 46 pivotably connected to a rear portion of the enclosure and covering any printed circuit boards installed in the enclosure 30.

Figure 21:
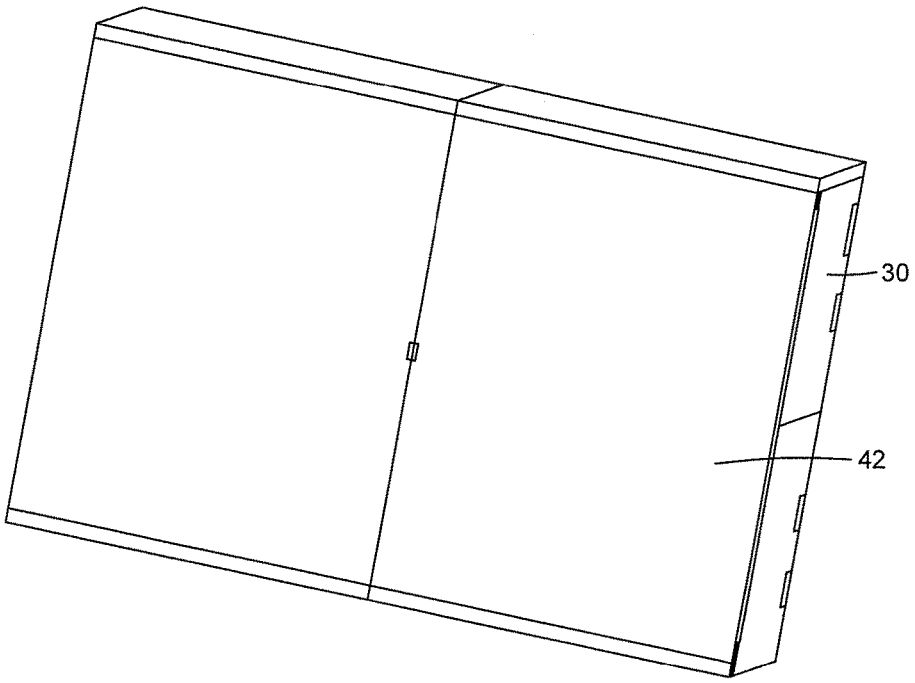
FIG. 21 is a front perspective view of a plurality of enclosures stacked together in accordance with another embodiment of the invention.
Figure 22:
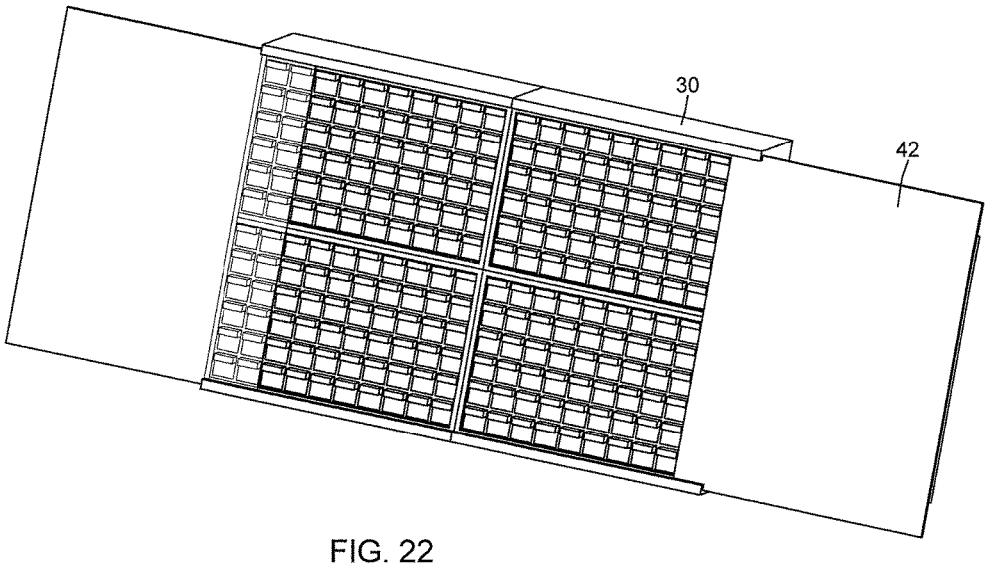
FIG. 22 is a front perspective view of the plurality of enclosures shown in FIG. 21 with door assemblies in an open configuration.
Figure 23:
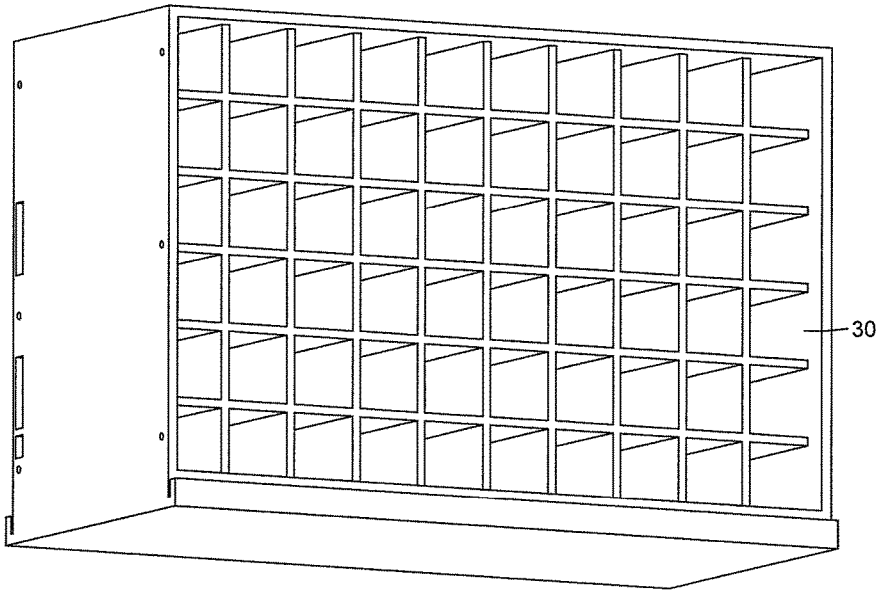
FIG. 23 is a front perspective view of a single enclosure of the plurality of enclosures shown in FIG. 21 with a door assembly removed.
Figure 24:
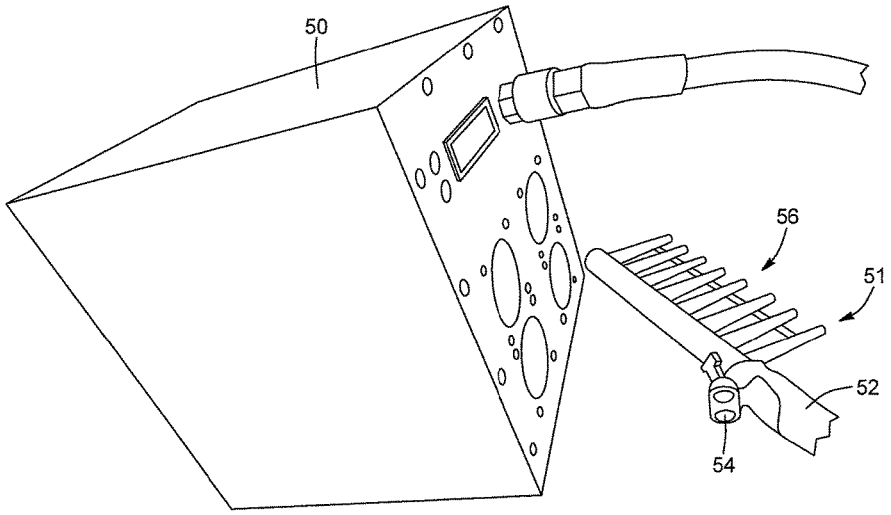
FIG. 24 is a perspective view of an item transfer system for transferring items from the enclosure to the container-defining sheet for the system shown in FIG. 1, according to an embodiment of the present invention.
Figure 25:
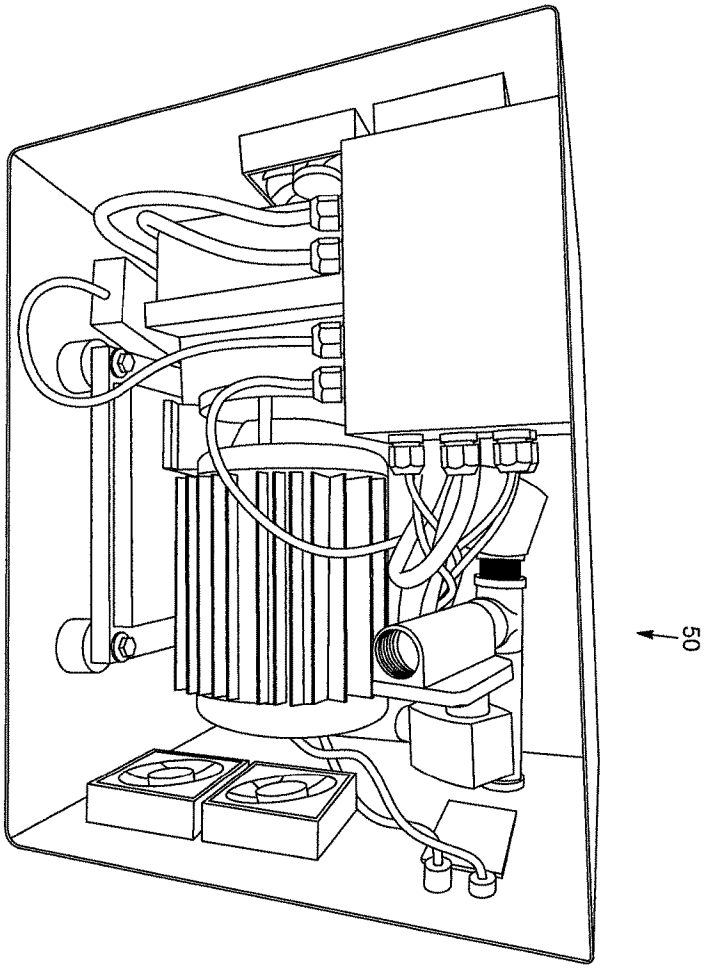
FIG. 25 is a side perspective view of the vacuum source of the item transfer system shown.

FIGS. 21 to 23 show another embodiment of the enclosure 30 made out of wood instead of sheet metal. The enclosures are to be designed and can be arranged in a modular manner such that the enclosures are easy to ship and assemble on-site. In general, the front door assemblies can be designed to retract behind the enclosure when the enclosure door assembly is unlocked. Moreover, the enclosure light illuminators do not necessarily back-light the drawers and can be positioned proximate the drawers for example in a front portion thereof, at about 0.5 cm beside each drawer. Each enclosure can include for example, 240 drawers and the illumination of multiple enclosures can be controlled through a single computer.

In some implementations, the system further includes an item transfer system for transferring items from the enclosure to the container-defining sheet. Such an item transfer system is described for example in Canadian patent application CA 2,843,074. The transfer system as shown in FIGS.

24 and 25 includes a vacuum supply 50 for generating suction and a filling assembly 51. The filling assembly 51 includes a handle 52, and a manifold 54 mounted about the handle and in fluid engagement with the vacuum supply 50 for receiving suction. A valve is operatively connected to the manifold 54 and is manually operable between a retain configuration wherein the valve is in an open position and suction is supplied to the manifold 54, and a release configuration wherein the valve is in a closed position and the manifold is free of suction. A plurality of prongs 56 are in fluid engagement with the manifold 54 and extends therefrom. Each prong is configured for applying suction to a corresponding item upon the valve being in the retain configuration, thereby retaining the object, and each prong is configured for releasing the retained object in a corresponding cavity of the container-defining sheet upon the valve being in the release configuration, thereby filling the container-defining sheet.

In some implementations, the system further includes a manipulator system, such as a robotic manipulator system, for displacing the filling assembly towards the container-defining sheet.

As may be appreciated, numerous modifications could be made to the preferred embodiment disclosed hereinabove without departing from the scope of the present invention. In this connection, it is worth reminding that the present invention, even though it is particularly well adapted to the manufacture of sets of individual pill containers for use in the pharmaceutical field, it could be used in other fields for other applications. It may also be noted that the number of containers may vary from one application to another and the shape and size of each of the containers may be modified as requested.

The invention claimed is:

1. A system for loading items into a container-defining sheet made of a plastic material, said container-defining sheet having a top surface comprising a given number of evenly spaced apart cavities embossed therein and defining a plurality of containers, the system comprising:

a support for receiving the container-defining sheet, the support having a top surface provided with a number of apertures at least equal to the number of cavities embossed in the container-defining sheet, said apertures being positioned, shaped and sized to receive the containers defined by said cavities embossed in the container-defining sheet;

a support illumination board positioned on a portion of the support, the support illumination board comprising a plurality of spaced-apart support light indicators, each support light indicator being positioned proximate to a corresponding aperture of the support and each support light indicator being adapted to illuminate one of said containers of the container-defining sheet upon placement of the container-defining sheet into the support;

a support illumination board controller connected to the support illumination board, the support illumination board controller controlling operation of the support light indicators to indicate into which container of the container-defining sheet each item is to be loaded; and an item transfer system for transferring items from the enclosure to the container-defining sheet, comprising:

a vacuum supply for generating suction; and a filling assembly comprising:

a handle;

a manifold mounted about the handle and in fluid engagement with the vacuum supply for receiving suction;

a valve operatively connected to the manifold and operable between a retain configuration wherein the valve is in an open position and suction is supplied to the manifold, and a release configuration wherein the valve is in a closed position and the manifold is free of suction; and a plurality of prongs in fluid engagement with the manifold and extending therefrom, each prong configured for applying suction to a corresponding item upon the valve being in the retain configuration, thereby retaining the object, and each prong configured for releasing the retained object in a corresponding cavity of the container-defining sheet upon the valve being in the release configuration, thereby filling the container-defining sheet.

2. The system according to claim 1, wherein the support illumination board controller comprises a microcontroller.

3. The system according to claim 1, wherein the light indicators are high intensity light emitting diodes (LEDs).

4. The system according to claim 3 wherein the high intensity LEDs are multi-color LEDs.

5. The system according to claim 1, further comprising at least one enclosure comprising a door assembly removably positionable in front of a plurality of drawers thereby blocking opening of the drawers and facilitating transport of the enclosure from one location to another.

6. The system according to claim 5, wherein each enclosure further comprises a locking mechanism for locking the door assembly.

7. The system according to claim 1, further comprising a plurality of enclosures, each enclosure comprising interfaces allowing an arrayed arrangement of the plurality of enclosures.

8. The system according to claim 1, further comprising an enclosure illumination assembly controller comprising a plurality of interconnected enclosure printed circuit boards, said enclosure printed circuit boards comprising at least one master board and at least one slave board.

9. The system according to claim 1, wherein the support illumination board controller comprises a plurality of interconnected support printed circuit boards, said support printed circuit boards comprising at least one master board and at least one slave board.

10. The system according to claim 1, further comprising a manipulator system for displacing the filling assembly towards the container-defining sheet.

* * * * *